US012663223B2

(12) United States Patent
Satou et al.

(10) Patent No.: US 12,663,223 B2
(45) Date of Patent: Jun. 23, 2026

(54) HEAT EXCHANGER

(71) Applicant: DAIKIN INDUSTRIES, LTD., Osaka (JP)

(72) Inventors: Ken Satou, Osaka (JP); Tooru Andou, Osaka (JP); Tomoki Hirokawa, Osaka (JP); Aya Okuno, Osaka (JP); Kengo Uchida, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 9 days.

(21) Appl. No.: 18/622,224

(22) Filed: Mar. 29, 2024

(65) Prior Publication Data

US 2024/0240877 A1 Jul. 18, 2024

Related U.S. Application Data

(63) Continuation of application No. PCT/JP2022/035752, filed on Sep. 26, 2022.

(30) Foreign Application Priority Data

Sep. 30, 2021 (JP) ..... 2021-162282

(51) Int. Cl.
*F28F 1/32* (2006.01)
*F28F 1/04* (2006.01)
*F28F 1/12* (2006.01)

(52) U.S. Cl.
CPC ..... *F28F 1/12* (2013.01); *F28F 1/04* (2013.01); *F28F 1/32* (2013.01); *F28F 2215/04* (2013.01)

(58) Field of Classification Search
CPC ..... F28F 1/12; F28F 1/24; F28F 1/32; F28F 1/325; F28F 2215/12
See application file for complete search history.

(56) References Cited

U.S. PATENT DOCUMENTS 2,512,540 A 6/1950 Friedman
4,546,822 A * 10/1985 Tamura ..... F28F 9/0226 165/149

(Continued)

FOREIGN PATENT DOCUMENTS

CN 109900136 A 6/2019
EP 3534103 A1 * 9/2019 ..... F28D 1/05383

(Continued)

OTHER PUBLICATIONS

International Search Report issued in corresponding International Application No. PCT/JP2022/035752 mailed Nov. 8, 2022 (5 pages).

(Continued)

*Primary Examiner* — Eric S Ruppert
(74) *Attorney, Agent, or Firm* — Osha Bergman Watanabe & Burton LLP

(57) ABSTRACT

A heat exchanger that exchanges heat between a refrigerant and air, includes: flat tubes disposed in a first direction intersecting with a longitudinal direction of cross sections of the flat tubes and through which the refrigerant flows; first heat transfer fins that contact the flat tubes and are disposed on a windward side of the flat tubes; and second heat transfer fins that contact the flat tubes and are disposed on a leeward side of the flat tubes. The first heat transfer fins are inserted toward the flat tubes from a side of first ends in the longitudinal direction. The second heat transfer fins are inserted toward the flat tubes from a side of second ends in the longitudinal direction.

19 Claims, 9 Drawing Sheets

(56) References Cited

U.S. PATENT DOCUMENTS

| | | | | |
|---|---|---|---|---|
| 6,789,614 | B2 * | 9/2004 | Sin | F28F 1/325 165/182 |
| 2015/0053377 | A1 * | 2/2015 | Hara | B23P 15/26 29/890.046 |
| 2020/0166278 | A1 | 5/2020 | Satou et al. | |

FOREIGN PATENT DOCUMENTS

| | | | | |
|---|---|---|---|---|
| JP | 02309194 | A | * | 12/1990 |
| JP | H03128167 | A | | 5/1991 |
| JP | H11304388 | A | * | 11/1999 |
| JP | 2011145023 | A | * | 7/2011 |
| JP | 2013221713 | A | | 10/2013 |
| JP | 2015042932 | A | | 3/2015 |
| JP | 2016084976 | A | | 5/2016 |
| JP | 2019015410 | A | | 1/2019 |
| JP | 2021081079 | A | | 5/2021 |
| WO | WO-2014129318 | A1 * | | 8/2014 ..... F28F 17/005 |
| WO | 2015037235 | A1 | | 3/2015 |
| WO | 2018078800 | A1 | | 5/2018 |

OTHER PUBLICATIONS

International Preliminary Report on Patentability issued in corresponding International Application No. PCT/JP2022/035752, mailed Apr. 11, 2024 (7 pages).

Extended European Search Report issued in corresponding European Patent Application No. 22876137.5, dated Jan. 2, 2025 (7 pages).

* cited by examiner

HEAT EXCHANGER

TECHNICAL FIELD

The present disclosure relates to a heat exchanger.

BACKGROUND

As disclosed in PTL 1 (Japanese Unexamined Patent Application Publication No. 2019-15410), there is known a heat exchanger in which heat transfer fins are inserted from a side of one ends in a longitudinal direction of cross sections of flat tubes.

SUMMARY

A heat exchanger of one or more embodiments exchanges heat between a refrigerant and air. The heat exchanger includes a plurality of flat tubes, a plurality of first heat transfer fins, and a plurality of second heat transfer fins. The plurality of flat tubes are arranged in a first direction intersecting with a longitudinal direction of cross sections of the flat tubes, and the refrigerant flows through an inside of the flat tubes. The plurality of first heat transfer fins are inserted with respect to the plurality of flat tubes from a side of first ends in the longitudinal direction of the cross sections of the flat tubes. The plurality of first heat transfer fins are in contact with the plurality of flat tubes. The plurality of first heat transfer fins are located on a windward side. The plurality of second heat transfer fins are inserted with respect to the plurality of flat tubes from a side of second ends in the longitudinal direction of the cross sections of the flat tubes. The plurality of second heat transfer fins are in contact with the plurality of flat tubes. The plurality of second heat transfer fins are located on a leeward side. The first heat transfer fins each include a plurality of first insertion portions and a first connection portion. The plurality of first insertion portions each are inserted between adjacent ones of the flat tubes. The first connection portion connects the plurality of first insertion portions on an outer side of the first ends in the longitudinal direction of the cross sections of the flat tubes. The first connection portion extends in the first direction. The second heat transfer fins each include a plurality of second insertion portions and a second connection portion. The plurality of second insertion portions each are inserted between adjacent ones of the flat tubes. The second connection portion connects the plurality of second insertion portions on an outer side of the second ends in the longitudinal direction of the cross sections of the flat tubes. The second connection portion extends in the first direction.

DETAILED DESCRIPTION

(1) General Configuration

Figure 1:
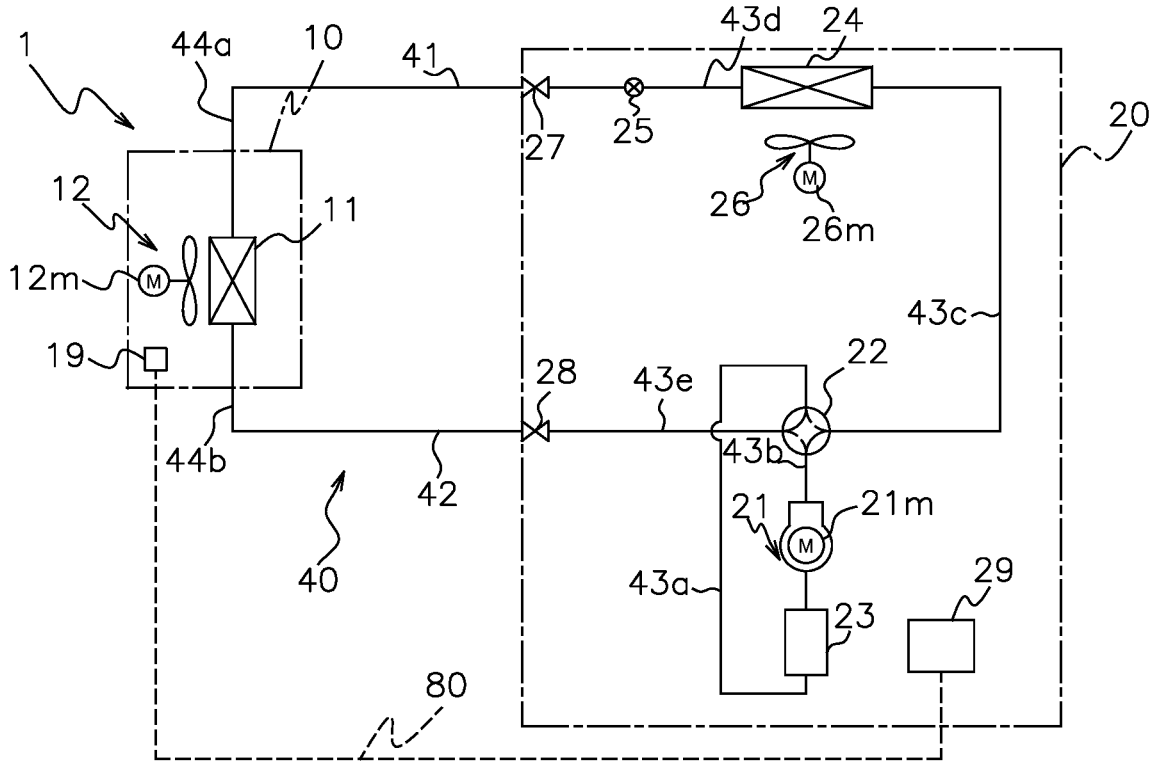
FIG. 1 is a diagram illustrating a refrigerant circuit of an air conditioner.

An air conditioner 1 is an apparatus that performs air conditioning in a target space using a vapor compression refrigeration cycle. FIG. 1 is a diagram illustrating a refrigerant circuit 40 of the air conditioner 1. As illustrated in FIG. 1, the air conditioner 1 mainly includes an indoor unit 10 and an outdoor unit 20. The refrigerant circuit 40 is constituted by the indoor unit 10 and the outdoor unit 20 being connected by a liquid refrigerant connection pipe 41 and a gas refrigerant connection pipe 42. Moreover, the indoor unit 10 and the outdoor unit 20 are communicably connected by a communication line 80.

(2) Detailed Configuration (2-1) Indoor Unit

The indoor unit 10 is installed in a target space to be air-conditioned, such as the inside of a room of a building in which the air conditioner 1 is installed. The indoor unit 10 is, for example, a wall-hooked unit or a ceiling-embedded unit. As illustrated in FIG. 1, the indoor unit 10 mainly includes an indoor heat exchanger 11, an indoor fan 12, and an indoor control unit 19. The indoor unit 10 also includes various sensors (not illustrated) such as an indoor temperature sensor. The indoor unit 10 also includes a liquid refrigerant pipe 44*a* that connects a liquid-side end of the indoor heat exchanger 11 with the liquid refrigerant connection pipe 41, and a gas refrigerant pipe 44*b* that connects a gas-side end of the indoor heat exchanger 11 with the gas refrigerant connection pipe 42.

(2-1-1) Indoor Heat Exchanger

The indoor heat exchanger 11 exchanges heat between a refrigerant flowing through the indoor heat exchanger 11 and air in the target space. The indoor heat exchanger 11 is, for example, a fin-and-tube heat exchanger including a plurality of heat transfer fins and a plurality of heat transfer tubes.

As illustrated in FIG. 1, one end of the indoor heat exchanger 11 is connected with the liquid refrigerant connection pipe 41 via the liquid refrigerant pipe 44*a*. The other end of the indoor heat exchanger 11 is connected with the gas refrigerant connection pipe 42 via the gas refrigerant pipe 44*b*. During a cooling operation, the refrigerant flows into the indoor heat exchanger 11 from the liquid refrigerant pipe 44*a*, and the indoor heat exchanger 11 functions as an evaporator of the refrigerant. During a heating operation, the refrigerant flows into the indoor heat exchanger 11 from the gas refrigerant pipe 44*b*, and the indoor heat exchanger 11 functions as a condenser of the refrigerant.

(2-1-2) Indoor Fan

The indoor fan 12 is a fan that supplies the air in the target space to the indoor heat exchanger 11. The indoor fan 12 is, for example, a cross-flow fan. As illustrated in FIG. 1, the indoor fan 12 is driven by an indoor fan motor 12*m*. The number of rotations of the indoor fan motor 12*m* can be controlled by an inverter.

(2-1-3) Indoor Control Unit

The indoor control unit 19 controls operations of components constituting the indoor unit 10.

The indoor control unit 19 is electrically connected with various devices included in the indoor unit 10, including the indoor fan motor 12*m*, so as to be able to transmit or receive control signals or information. The indoor control unit 19 is also communicably connected with the various sensors provided in the indoor unit 10.

The indoor control unit 19 includes a control calculation device and a storage device. The control calculation device is a processor such as a CPU or a GPU. The storage device is a storage medium such as a RAM, a ROM, and a flash memory. The control calculation device controls the operations of the components constituting the indoor unit 10 by reading a program stored in the storage device and performing predetermined calculation processing in accordance with the program. Moreover, the control calculation device can write a calculation result in the storage device or read information stored in the storage device in accordance with the program.

The indoor control unit 19 is configured to be able to receive various signals transmitted from an operation remote controller (not illustrated). The various signals include, for example, signals for instructing start and stop of an operation, and signals relating to various settings. The signals relating to the various settings include, for example, signals relating to a set temperature and a set humidity.

The indoor control unit 19 transmits or receives various signals and the like to or from an outdoor control unit 29 of the outdoor unit 20 via the communication line 80. The indoor control unit 19 and the outdoor control unit 29 cooperate with each other to function as a controller 60. The function of the controller 60 will be described later.

(2-2) Outdoor Unit

The outdoor unit 20 is installed, for example, outside a room such as a garden or a balcony of the building in which the air conditioner 1 is installed. As illustrated in FIG. 1, the outdoor unit 20 mainly includes a compressor 21, a flow path switching valve 22, an accumulator 23, an outdoor heat exchanger 24, an outdoor expansion valve 25, an outdoor fan 26, and the outdoor control unit 29. The outdoor unit 20 also includes various sensors (not illustrated) such as an outdoor temperature sensor.

As illustrated in FIG. 1, the outdoor unit 20 includes a suction pipe 43*a*, a discharge pipe 43*b*, a first gas refrigerant pipe 43*c*, a liquid refrigerant pipe 43*d*, and a second gas refrigerant pipe 43*e*. The suction pipe 43*a* connects the flow path switching valve 22 with a suction end of the compressor 21. The accumulator 23 is provided in the suction pipe 43*a*. The discharge pipe 43*b* connects a discharge end of the compressor 21 with the flow path switching valve 22. The first gas refrigerant pipe 43*c* connects the flow path switching valve 22 with a gas-side end of the outdoor heat exchanger 24. The liquid refrigerant pipe 43*d* connects a liquid-side end of the outdoor heat exchanger 24 with the liquid refrigerant connection pipe 41. The liquid refrigerant pipe 43*d* is provided with the outdoor expansion valve 25. Moreover, a liquid shutoff valve 27 is provided at a connection portion of the liquid refrigerant pipe 43*d* with respect to the liquid refrigerant connection pipe 41. The second gas refrigerant pipe 43*e* connects the flow path switching valve 22 with the gas refrigerant connection pipe 42. A gas shutoff valve 28 is provided at a connection portion of the second gas refrigerant pipe 43*e* with respect to the gas refrigerant connection pipe 42. The liquid shutoff valve 27 and the gas shutoff valve 28 are valves that are manually opened or closed.

(2-2-1) Compressor

The compressor 21 sucks the refrigerant with a low pressure, compresses the refrigerant using a compression mechanism (not illustrated), and discharges the compressed refrigerant. The compressor 21 is, for example, a rotary type or scroll type positive-displacement compressor. The compression mechanism of the compressor 21 is driven by a compressor motor 21*m*. The number of rotations of the compressor motor 21*m* can be controlled by an inverter.

(2-2-2) Flow Path Switching Valve

The flow path switching valve 22 is a mechanism that switches the flow path of the refrigerant between a first state and a second state. In the first state, as indicated by solid lines in the flow path switching valve 22 in FIG. 1, the flow path switching valve 22 causes the suction pipe 43*a* to communicate with the second gas refrigerant pipe 43*e* and causes the discharge pipe 43*b* to communicate with the first gas refrigerant pipe 43*c*. In the second state, as indicated by broken lines in the flow path switching valve 22 in FIG. 1, the flow path switching valve 22 causes the suction pipe 43*a* to communicate with the first gas refrigerant pipe 43*c* and causes the discharge pipe 43*b* to communicate with the second gas refrigerant pipe 43*e*.

The flow path switching valve 22 sets the flow path of the refrigerant to the first state during the cooling operation. In this case, the refrigerant discharged from the compressor 21 flows through the outdoor heat exchanger 24, the outdoor expansion valve 25, and the indoor heat exchanger 11 in this order in the refrigerant circuit 40, and returns to the compressor 21. In the first state, the outdoor heat exchanger 24 functions as a condenser, and the indoor heat exchanger 11 functions as an evaporator.

The flow path switching valve 22 sets the flow path of the refrigerant to the second state during the heating operation. In this case, the refrigerant discharged from the compressor 21 flows through the indoor heat exchanger 11, the outdoor expansion valve 25, and the outdoor heat exchanger 24 in this order in the refrigerant circuit 40, and returns to the compressor 21. In the second state, the outdoor heat exchanger 24 functions as an evaporator, and the indoor heat exchanger 11 functions as a condenser.

(2-2-3) Accumulator

The accumulator 23 has a gas-liquid separation function of separating the refrigerant flowing therein into the gas refrigerant and the liquid refrigerant. The refrigerant flowing into the accumulator 23 is separated into the gas refrigerant and the liquid refrigerant, and the gas refrigerant collected in an upper space flows out to the compressor 21.

(2-2-4) Outdoor Heat Exchanger

The outdoor heat exchanger 24 exchanges heat between the refrigerant flowing inside the outdoor heat exchanger 24 and outdoor air. The structure of the outdoor heat exchanger 24 will be described in detail later.

One end of the outdoor heat exchanger 24 is connected with the liquid refrigerant connection pipe 41 via the liquid refrigerant pipe 43*d*. The other end of the outdoor heat exchanger 24 is connected with the flow path switching valve 22 via the first gas refrigerant pipe 43*c*. During the cooling operation, the refrigerant flows into the outdoor heat exchanger 24 from the first gas refrigerant pipe 43*c*, and the outdoor heat exchanger 24 functions as a condenser of the refrigerant. During the heating operation, the refrigerant flows into the outdoor heat exchanger 24 from the liquid refrigerant pipe 43*d*, and the outdoor heat exchanger 24 functions as an evaporator of the refrigerant.

(2-2-5) Outdoor Expansion Valve

The outdoor expansion valve 25 is a mechanism for adjusting the pressure and flow rate of the refrigerant flowing through the refrigerant circuit 40. The outdoor expansion valve 25 is, for example, an electronic expansion valve.

(2-2-6) Outdoor Fan

The outdoor fan 26 is a fan that supplies air to the outdoor heat exchanger 24. The outdoor fan 26 is, for example, a propeller fan. The outdoor fan 26 is driven by an outdoor fan motor 26*m*. The number of rotations of the outdoor fan motor 26*m* can be controlled by an inverter.

(2-2-7) Outdoor Control Unit

The outdoor control unit 29 controls operations of components constituting the outdoor unit 20.

The outdoor control unit 29 is electrically connected with various devices included in the outdoor unit 20, including the compressor motor 21*m*, the flow path switching valve 22, the outdoor expansion valve 25, and the outdoor fan motor 26*m*, so as to be able to transmit or receive control signals or information. The outdoor control unit 29 is also communicably connected with the various sensors provided in the outdoor unit 20.

The outdoor control unit 29 includes a control calculation device and a storage device. The control calculation device is a processor such as a CPU or a GPU. The storage device is a storage medium such as a RAM, a ROM, and a flash memory. The control calculation device controls the operations of the components constituting the outdoor unit 20 by reading a program stored in the storage device and performing predetermined calculation processing in accordance with the program. Moreover, the control calculation device can write a calculation result in the storage device or read information stored in the storage device in accordance with the program.

The outdoor control unit 29 transmits or receives various signals and the like to or from the indoor control unit 19 of the indoor unit 10 via the communication line 80. The indoor control unit 19 and the outdoor control unit 29 cooperate with each other to function as the controller 60. The function of the controller 60 will be described later.

(2-3) Controller

The controller 60 is constituted by communicably connecting the indoor control unit 19 and the outdoor control unit 29 via the communication line 80. The controller 60 controls the entire operation of the air conditioner 1 by the respective control calculation devices of the indoor control unit 19 and the outdoor control unit 29 executing the programs stored in the respective storage devices.

Figure 2:
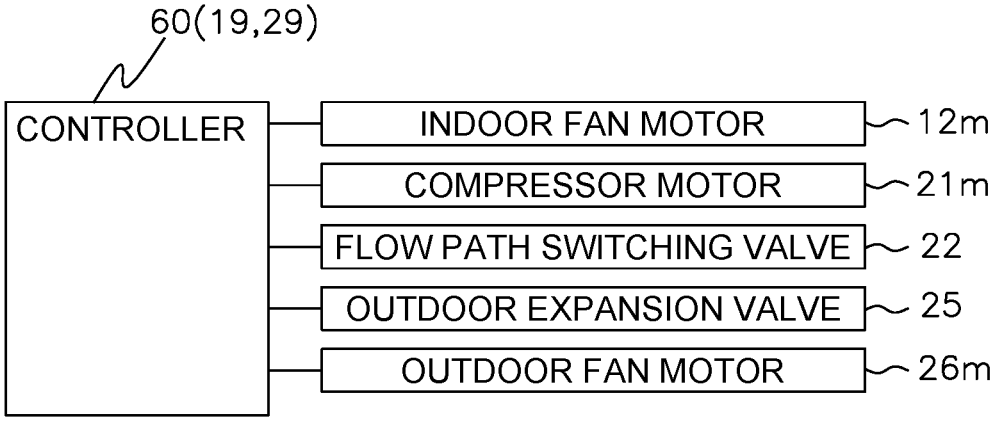
FIG. 2 is a control block diagram of the air conditioner.

FIG. 2 is a control block diagram of the air conditioner 1. As illustrated in FIG. 2, the controller 60 is electrically connected with the various devices included in the indoor unit 10 and the outdoor unit 20, including the indoor fan motor 12*m*, the compressor motor 21*m*, the flow path switching valve 22, the outdoor expansion valve 25, and the outdoor fan motor 26*m*, so as to be able to transmit or receive control signals or information. The controller 60 is also communicably connected with the various sensors provided in the indoor unit 10 and the outdoor unit 20.

The controller 60 controls the start and stop of an operation of the air conditioner 1 and operations of various devices of the air conditioner 1 based on measurement signals of the various sensors, commands received by the indoor control unit 19 from the operation remote controller, and the like. Further, the controller 60 can transmit information such as a current operation state and various notifications to the operation remote controller.

The controller 60 mainly performs the cooling operation and the heating operation.

(2-3-1) Cooling Operation

The cooling operation is an operation of cooling the target space to a set temperature.

The controller 60 receives an instruction to start the cooling operation and an instruction of a set temperature from, for example, the operation remote controller. The controller 60 switches the flow path switching valve 22 to the first state. During the cooling operation, the flow path switching valve 22 causes the high-temperature and high-pressure gas refrigerant discharged from the compressor 21 to flow into the outdoor heat exchanger 24. The outdoor heat exchanger 24 exchanges heat between the refrigerant and the outdoor air supplied by the outdoor fan 26. The refrigerant cooled by the outdoor heat exchanger 24 is decompressed by the outdoor expansion valve 25 and flows into the indoor heat exchanger 11. The indoor heat exchanger 11 exchanges heat between the refrigerant and the air in the target space supplied by the indoor fan 12. The refrigerant heated through heat exchange in the indoor heat exchanger 11 is sucked into the compressor 21 via the flow path switching valve 22 and the accumulator 23. The air in the target space cooled by the indoor heat exchanger 11 is blown from the indoor unit 10 to the target space, so that the target space is cooled.

(2-3-2) Heating Operation

The heating operation is an operation of heating the target space to a set temperature.

The controller 60 receives an instruction to start the heating operation and an instruction of a set temperature from, for example, the operation remote controller. The controller 60 switches the flow path switching valve 22 to the second state. During the heating operation, the flow path switching valve 22 causes the high-temperature and high-pressure gas refrigerant discharged from the compressor 21 to flow into the indoor heat exchanger 11. The indoor heat exchanger 11 exchanges heat between the refrigerant and the air in the target space supplied by the indoor fan 12. The refrigerant cooled by the indoor heat exchanger 11 is decompressed by the outdoor expansion valve 25 and flows into the outdoor heat exchanger 24. The outdoor heat exchanger 24 exchanges heat between the refrigerant and the outdoor air supplied by the outdoor fan 26. The refrigerant heated through heat exchange in the outdoor heat exchanger 24 is sucked into the compressor 21 via the flow path switching valve 22 and the accumulator 23. The air in the target space heated by the indoor heat exchanger 11 is blown from the indoor unit 10 to the target space, so that the target space is heated.

(3) Structure of Outdoor Heat Exchanger

Figure 3:
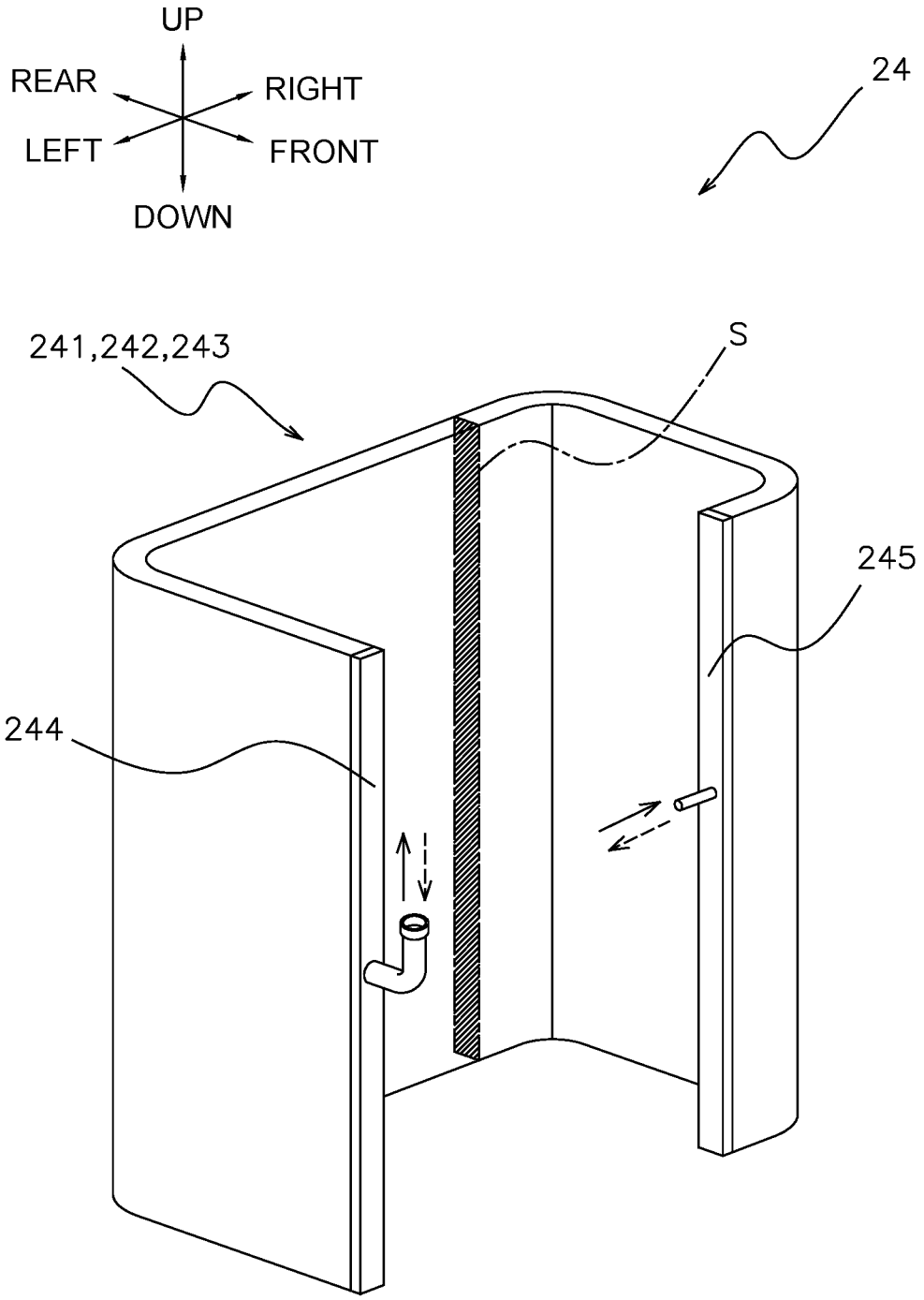
FIG. 3 is an external perspective view of an outdoor heat exchanger.
Figure 4:
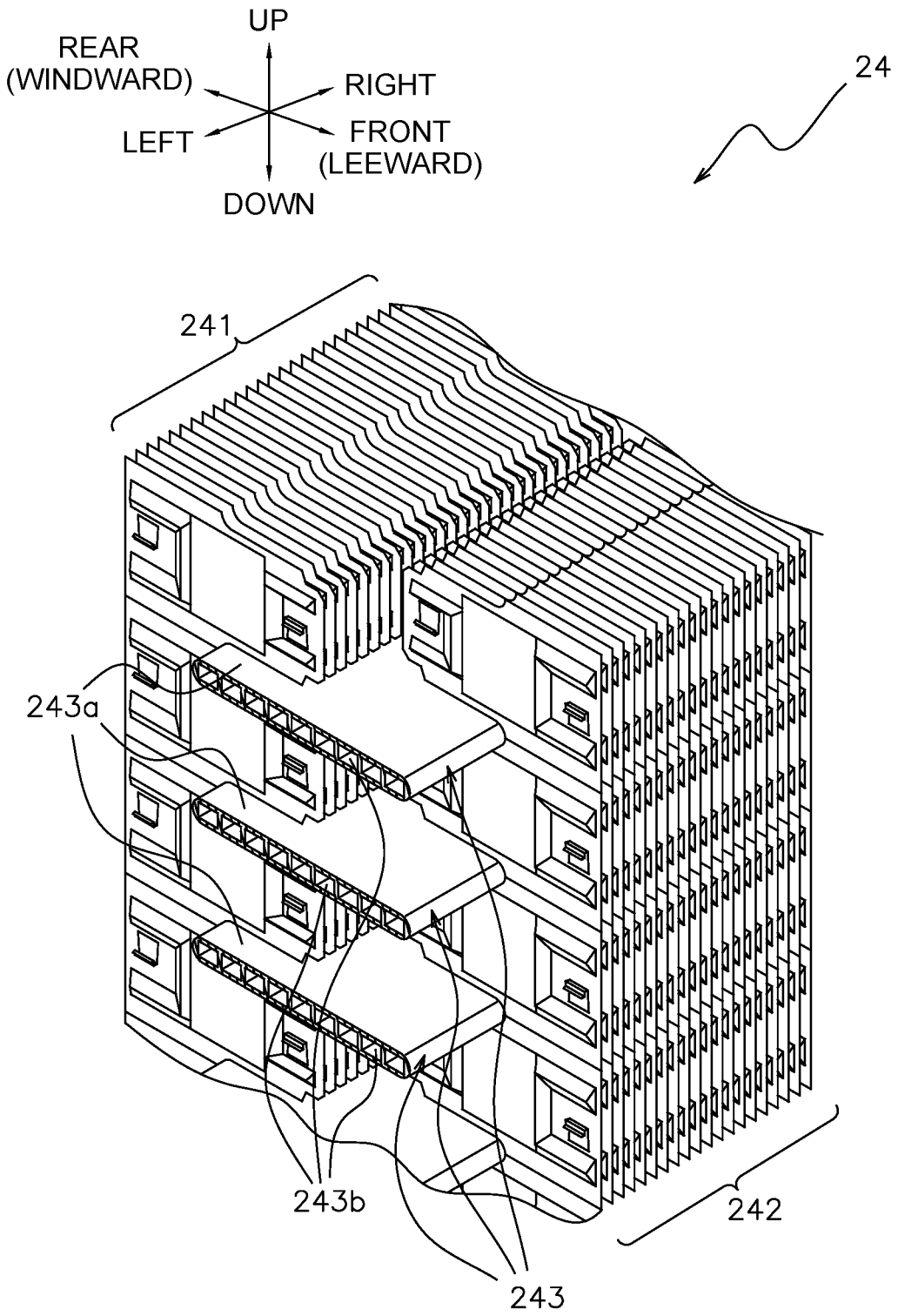
FIG. 4 is an enlarged perspective sectional view of the outdoor heat exchanger.
Figure 5:
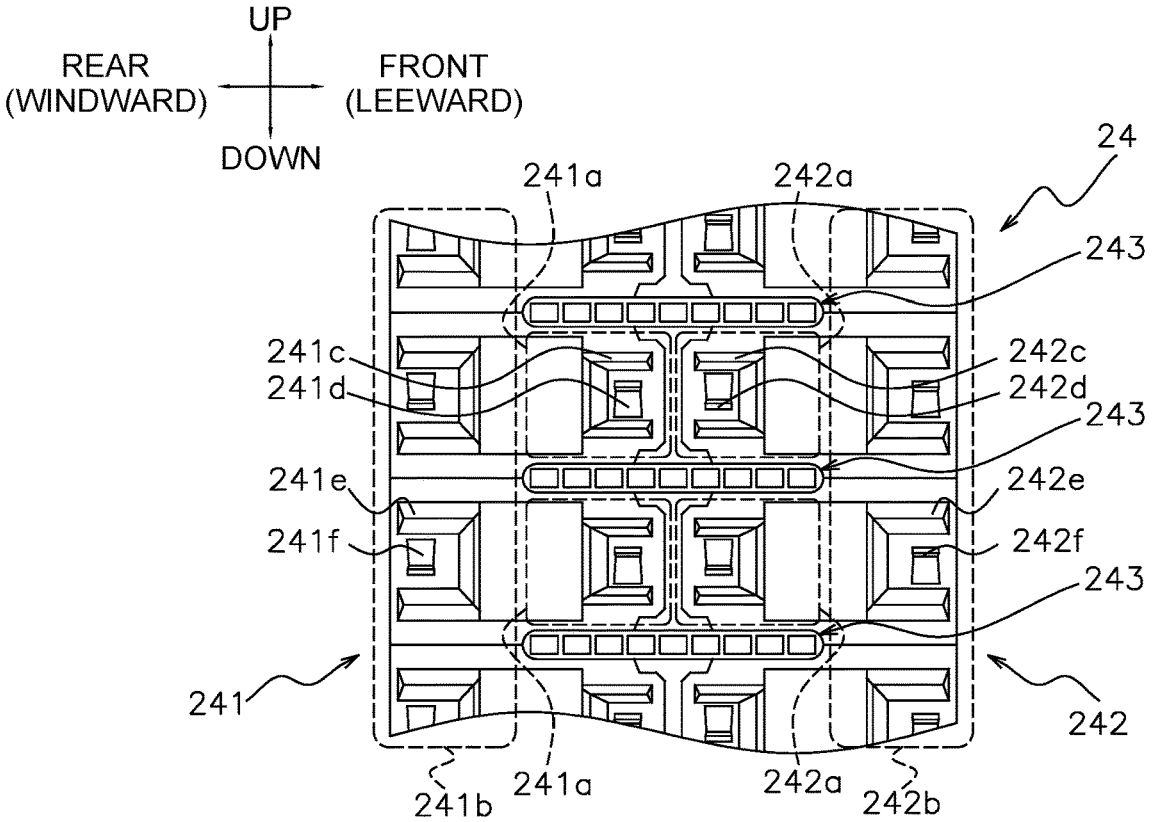
FIG. 5 is an enlarged sectional view of the outdoor heat exchanger.
Figure 6:
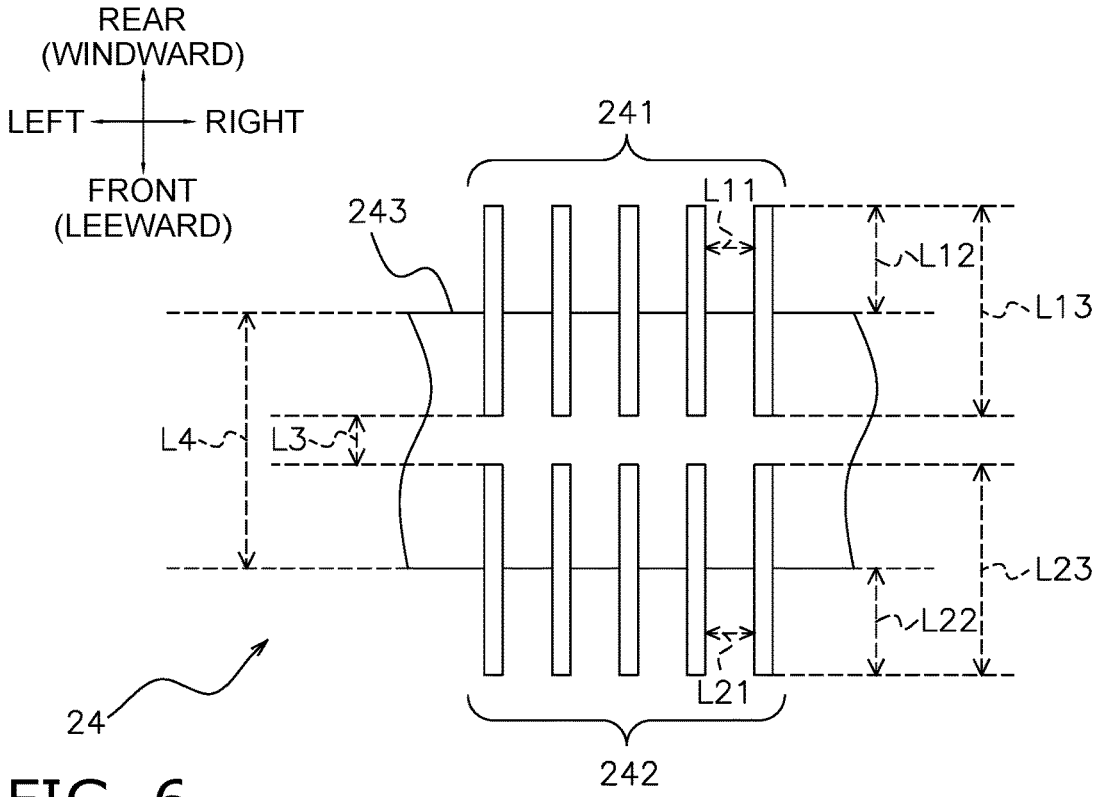
FIG. 6 is a schematic top view of the outdoor heat exchanger.

FIG. 3 is an external perspective view of the outdoor heat exchanger 24. FIG. 4 is an enlarged perspective sectional view of the outdoor heat exchanger 24. FIG. 5 is an enlarged sectional view of the outdoor heat exchanger 24. FIG. 6 is a schematic top view of the outdoor heat exchanger 24.

As illustrated in FIG. 3, an outer surface of the outdoor heat exchanger 24 faces a left side surface, a rear surface, a right side surface, and a right portion of a front surface of the outdoor unit 20 that is a rectangular parallelepiped. The compressor 21, the accumulator 23, the outdoor fan 26, and the like described above are disposed in a space surrounded by an inner surface of the outdoor heat exchanger 24. When the outdoor fan 26 blows air forward, the outdoor air flows from a side of the outer surface to a side of the inner surface of the outdoor heat exchanger 24.

As illustrated in FIG. 4, the outdoor heat exchanger 24 includes a plurality of flat tubes 243, a plurality of first heat transfer fins 241, and a plurality of second heat transfer fins 242.

(3-1) Flat Tubes

As illustrated in FIGS. 3 and 4, the plurality of flat tubes 243 are arranged in an up-down direction (first direction) intersecting with a front-rear direction (longitudinal direction) of cross sections S of the flat tubes 243. The refrigerant flows through the inside of the flat tubes 243. The plurality of flat tubes 243 each have a planar portion 243*a* serving as a heat transfer surface and a plurality of (nine in FIG. 4) internal flow paths 243*b* through which the refrigerant flows. The flat tubes 243 are arranged in a plurality of stages so as to be stacked at intervals in a state in which the planar portions 243*a* are vertically oriented.

The flat tubes 243 are formed of aluminum or an aluminum alloy.

(3-2) Heat Transfer Fins

As illustrated in FIG. 4, the plurality of first heat transfer fins 241 are inserted with respect to the plurality of flat tubes 243 from a rear side (a side of first ends) in the front-rear direction (longitudinal direction) of the cross sections S of the flat tubes 243. The plurality of first heat transfer fins 241 are in contact with the planar portions 243*a* of the plurality of flat tubes 243. The plurality of first heat transfer fins 241 are located on a windward side.

As illustrated in FIG. 5, the first heat transfer fins 241 each include a plurality of first insertion portions 241*a* and a first connection portion 241*b*. The plurality of first insertion portions 241*a* each are inserted between adjacent ones of the flat tubes 243. The first connection portion 241*b* connects the plurality of first insertion portions 241*a* on an outer side of rear ends (first ends) in the front-rear direction (longitudinal direction) of the cross sections S of the flat tubes 243. The first connection portion 241*b* extends in the up-down direction (first direction).

The first insertion portions 241*a* each have a rib 241*c* and a fin tab 241*d*. The rib 241*c* is formed by being bulged leftward in an angular C-like mountain shape. The fin tab 241*d* is formed by being cut and raised leftward. The fin tab 241*d* maintains an interval (fin pitch L11) between adjacent ones of the first heat transfer fins 241.

The first connection portion 241*b* has a rib 241*e* and a fin tab 241*f*. The rib 241*e* is formed by being bulged leftward in an angular C-like mountain shape. The fin tab 241*f* is formed by being cut and raised leftward. The fin tab 241*f* maintains an interval (fin pitch L11) between adjacent ones of the first heat transfer fins 241.

As illustrated in FIG. 4, the plurality of second heat transfer fins 242 are inserted with respect to the plurality of flat tubes 243 from a front side (a side of second ends) in the front-rear direction (longitudinal direction) of the cross sections S of the flat tubes 243. The plurality of second heat transfer fins 242 are in contact with the planar portions 243*a* of the plurality of flat tubes 243. The plurality of second heat transfer fins 242 are located on a leeward side.

As illustrated in FIG. 5, the second heat transfer fins 242 each include a plurality of second insertion portions 242*a* and a second connection portion 242*b*. The plurality of second insertion portions 242*a* each are inserted between adjacent ones of the flat tubes 243. The second connection portion 242*b* connects the plurality of second insertion portions 242*a* on an outer side of front ends (second ends) in the front-rear direction (longitudinal direction) of the cross sections S of the flat tubes 243. The second connection portion 242*b* extends in the up-down direction (first direction).

The second insertion portions 242*a* each have a rib 242*c* and a fin tab 242*d*. The rib 242*c* is formed by being bulged leftward in an angular C-like mountain shape. The fin tab 242*d* is formed by being cut and raised leftward. The fin tab 242*d* maintains an interval (fin pitch L21) between adjacent ones of the second heat transfer fins 242.

The second connection portion 242*b* has a rib 242*e* and a fin tab 242*f*. The rib 242*e* is formed by being bulged leftward in an angular C-like mountain shape. The fin tab 242*f* is formed by being cut and raised leftward. The fin tab 242*f* maintains an interval (fin pitch L21) between adjacent ones of the second heat transfer fins 242.

As illustrated in FIG. 6, the positions of the first heat transfer fins 241 and the positions of the second heat transfer fins 242 are substantially aligned with each other in the front-rear direction. The fin pitch L11 of the plurality of first heat transfer fins 241 is equal to the fin pitch L21 of the plurality of second heat transfer fins 242. A width L12 in an air flow direction of the first connection portion 241*b* is equal to a width L22 in the air flow direction of the second connection portion 242*b*. A distance L3 in the air flow direction between the plurality of first heat transfer fins 241 and the plurality of second heat transfer fins 242 is 1 mm or more and is 20% or less of a length L4 in the front-rear direction (longitudinal direction) of the cross sections S of the flat tubes 243. The length L4 is, for example, 10 mm to 22 mm.

In the present embodiments, the first heat transfer fin 241 and the second heat transfer fin 242 are formed of a clad material.

(3-3) Headers

As illustrated in FIG. 3, during the cooling operation, a header 244 merges the refrigerant flowing from the compressor 21 side through the first gas refrigerant pipe 43*c* into the outdoor heat exchanger 24 (in a direction of a solid line arrow in FIG. 3) and distributed to the internal flow paths 243*b* of the plurality of flat tubes 243 by a header 245, which will be described later, and causes the refrigerant to flow into the liquid refrigerant pipe 43*d*. During the heating operation, the header 244 distributes the refrigerant flowing from the outdoor expansion valve 25 side through the liquid refrigerant pipe 43*d* into the outdoor heat exchanger 24 (in a direction of a broken line arrow in FIG. 3) to the internal flow paths 243*b* of the plurality of flat tubes 243.

During the cooling operation, the header 245 distributes the refrigerant flowing from the compressor 21 side through the first gas refrigerant pipe 43*c* into the outdoor heat exchanger 24 (in a direction of a solid line arrow in FIG. 3) to the internal flow paths 243*b* of the plurality of flat tubes 243. During the heating operation, the header 245 merges the refrigerant flowing from the outdoor expansion valve 25 side through the liquid refrigerant pipe 43*d* into the outdoor heat exchanger 24 (in a direction of a broken line arrow in FIG. 3) and distributed to the internal flow paths 243*b* of the plurality of flat tubes 243 by the header 244, and causes the refrigerant to flow into the first gas refrigerant pipe 43*c*.

(4) Verification

Figure 7:
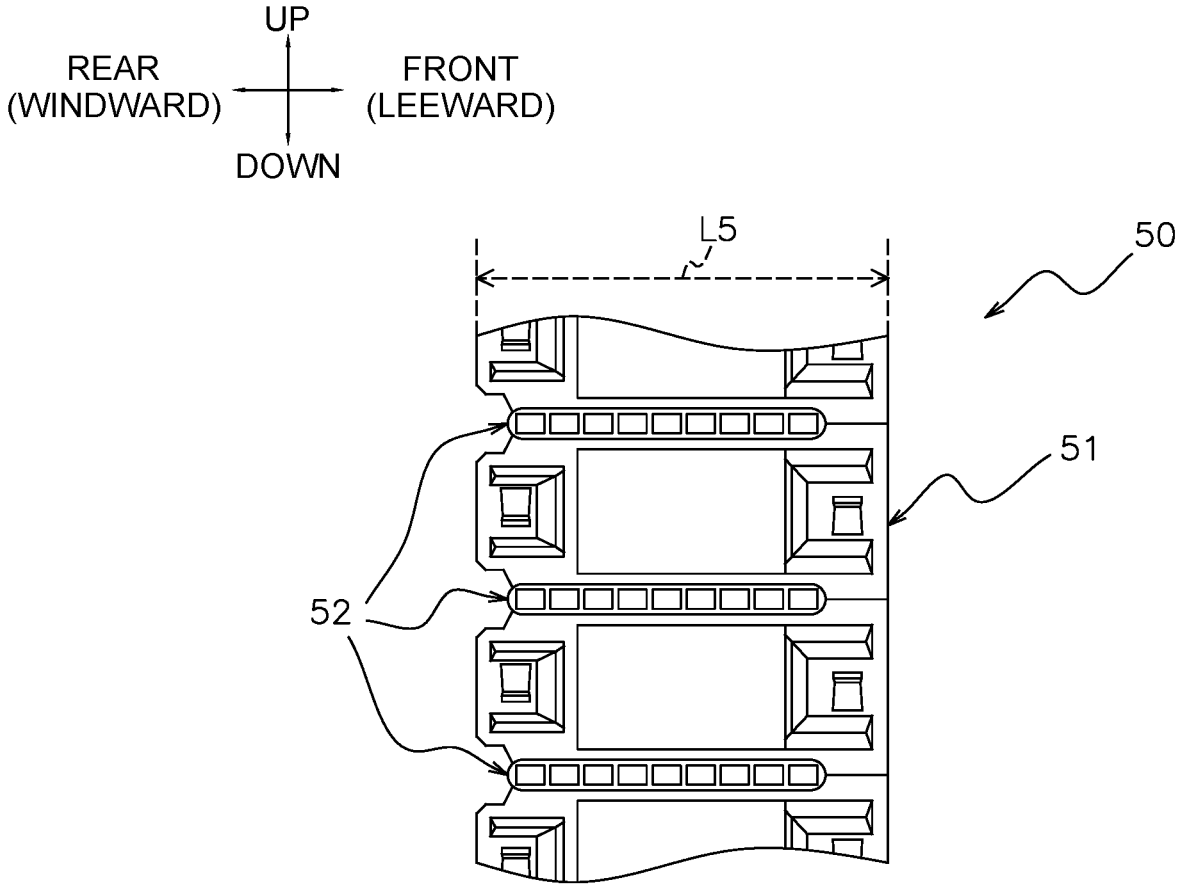
(PRIOR ART) FIG. 7
FIG. 7 is an enlarged sectional view of an outdoor heat exchanger of related art.

In this verification, heating capacities of the outdoor heat exchanger 24 according to the present embodiments and an outdoor heat exchanger 50 of related art in which a plurality of heat transfer fins 51 are inserted from the leeward side were compared when the heating operation was performed at a low outdoor temperature. FIG. 7 is an enlarged sectional view of the outdoor heat exchanger 50 of the related art.

As illustrated in FIG. 6, in this verification, a distance L3 in the air flow direction between the first heat transfer fin 241 and the second heat transfer fin 242 was set to 1.4 mm, and a length L13 in the air flow direction of the first heat transfer fin 241 and a length L23 in the air flow direction of the second heat transfer fin 242 were set to 20 mm. Thus, a length (L3+L13+L23) in the air flow direction of the outdoor heat exchanger 24 is 41.4 mm. In contrast, as illustrated in FIG. 7, a length L5 in the air flow direction of the outdoor heat exchanger 50 was set to 30 mm. Other values, such as heat transfer areas, sizes, and the number of stages of flat tubes 52, 243, are set substantially similarly.

Figure 8:
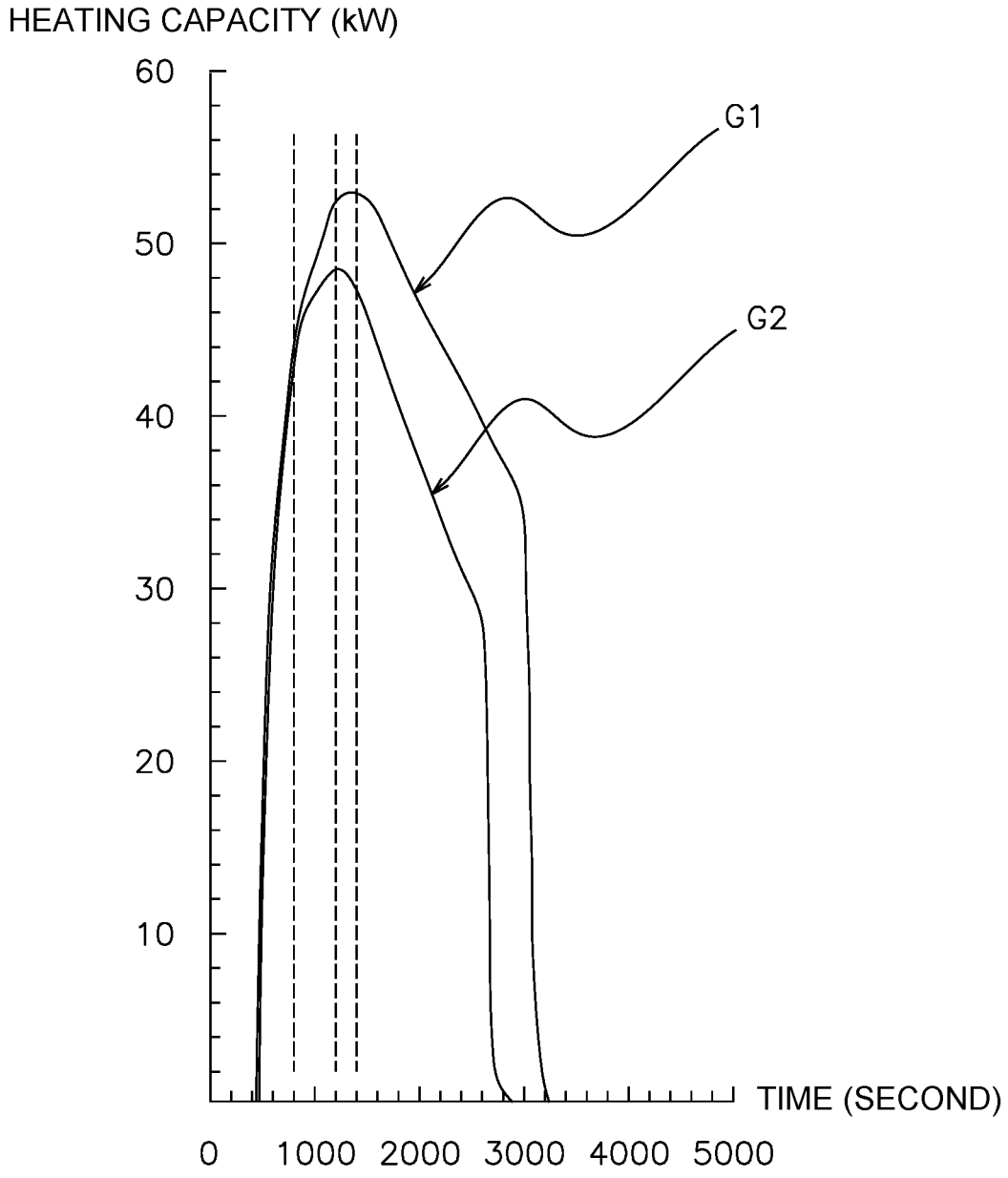
FIG. 8 is a graph presenting verification results.

FIG. 8 is a graph presenting verification results. A graph G1 presents the change over time in the heating capacity of the outdoor heat exchanger 24. A graph G2 presents the change over time in the heating capacity of the outdoor heat exchanger 50. The heating capacities of the outdoor heat exchanger 24 and the outdoor heat exchanger 50 similarly increase until about 800 seconds elapse from the start of the heating operation. Thereafter, the heating capacity of the outdoor heat exchanger 24 reaches its peak when about 1400 seconds have elapsed. Then, the heating capacity of the outdoor heat exchanger 24 gradually decreases due to frosting, and the heating capacity is lost when about 3200 seconds have elapsed. In contrast, the heating capacity of the outdoor heat exchanger 50 reaches its peak (which is lower than that of the outdoor heat exchanger 24) when about 1200 seconds have elapsed. Then, the heating capacity of the outdoor heat exchanger 50 decreases due to frosting (more rapidly than the outdoor heat exchanger 24), and the heating capacity is lost when about 2800 seconds have elapsed.

In the outdoor heat exchanger 50, the windward side of the flat tubes 52 is exposed, and there is no connection portion of the heat transfer fins 51 on the windward side of the flat tubes 52. Thus, dew condensation water cannot be properly drained, and frosting is likely to occur. Therefore, it is considered that the peak of the heating capacity of the outdoor heat exchanger 50 is lower than that of the outdoor heat exchanger 24, and the heating capacity of the outdoor heat exchanger 50 decreases more rapidly than that of the outdoor heat exchanger 24.

When a defrosting operation is performed at a proper timing in anticipation of a decrease in the heating capacity, the air conditioner 1 including the outdoor heat exchanger 24 of the present embodiments can reduce the frequency of the defrosting operation and extend the time during which the heating operation is performed, as compared to an air conditioner of related art including the outdoor heat exchanger 50, because frosting is delayed.

(5) Features (5-1)

In related art, there is known a heat exchanger in which heat transfer fins are inserted from a side of one ends in a longitudinal direction of cross sections of flat tubes.

When a heating operation is performed at a low outdoor temperature, the heat exchanger of the related art does not include a connection portion of the heat transfer fins on a windward side or a leeward side, and hence dew condensation water cannot be properly drained and frosting is likely to occur.

An outdoor heat exchanger 24 of the present embodiments exchanges heat between a refrigerant and air. The outdoor heat exchanger 24 includes a plurality of flat tubes 243, a plurality of first heat transfer fins 241, and a plurality of second heat transfer fins 242. The plurality of flat tubes 243 are arranged in an up-down direction intersecting with a front-rear direction of cross sections S of the flat tubes 243. The refrigerant flows through an inside of the flat tubes 243. The plurality of first heat transfer fins 241 are inserted with respect to the plurality of flat tubes 243 from a rear side in the front-rear direction of the cross sections S of the flat tubes 243. The plurality of first heat transfer fins 241 are in contact with the plurality of flat tubes 243. The plurality of first heat transfer fins 241 are located on a windward side. The plurality of second heat transfer fins 242 are inserted with respect to the plurality of flat tubes 243 from a front side in the front-rear direction of the cross sections S of the flat tubes 243. The plurality of second heat transfer fins 242 are in contact with the plurality of flat tubes 243. The plurality of second heat transfer fins 242 are located on a leeward side. The first heat transfer fins 241 each include a plurality of first insertion portions 241*a* and a first connection portion 241*b*. The plurality of first insertion portions 241*a* each are inserted between adjacent ones of the flat tubes 243. The first connection portion 241*b* connects the plurality of first insertion portions 241*a* on an outer side of rear ends in the front-rear direction of the cross sections S of the flat tubes 243. The first connection portion 241*b* extends in the up-down direction. The second heat transfer fins 242 each include a plurality of second insertion portions 242*a* and a second connection portion 242*b*. The plurality of second insertion portions 242*a* each are inserted between adjacent ones of the flat tubes 243. The second connection portion 242*b* connects the plurality of second insertion portions 242*a* on an outer side of front ends in the front-rear direction of the cross sections S of the flat tubes 243. The second connection portion 242*b* extends in the up-down direction.

The first heat transfer fin 241 includes the first connection portion 241*b*. The first connection portion 241*b* connects the plurality of first insertion portions 241*a* on the outer side of the rear ends in the front-rear direction of the cross sections S of the flat tubes 243. The first connection portion 241*b* extends in the up-down direction. The second heat transfer fin 242 includes the second connection portion 242*b*. The second connection portion 242*b* connects the plurality of second insertion portions 242*a* on the outer side of the front ends in the front-rear direction of the cross sections S of the flat tubes 243. The second connection portion 242*b* extends in the up-down direction.

Consequently, since the outdoor heat exchanger 24 includes the first connection portion 241*b* of the first heat transfer fin 241 and the second connection portion 242*b* of the second heat transfer fin 242 on both sides of the flat tubes 243, the outdoor heat exchanger 24 can improve drainage performance and delay frosting.

(5-2)

In the outdoor heat exchanger 24 of the present embodiments, a distance L3 in an air flow direction between the first heat transfer fin 241 and the second heat transfer fin 242 is 1 mm or more and is 20% or less of a length L4 in the front-rear direction of the cross sections S of the flat tubes 243.

Consequently, the outdoor heat exchanger 24 can prevent an end portion on the windward side of the second heat transfer fin 242 from being closed by frosting and delay frosting.

(5-3)

In the outdoor heat exchanger 24 of the present embodiments, the first heat transfer fin 241 and the second heat transfer fin 242 are formed of a clad material.

Consequently, the outdoor heat exchanger 24 can ensure hydrophilicity of the first heat transfer fin 241 and the second heat transfer fin 242 and improve drainage performance.

(6) Modifications (6-1) Modification 1A

Figure 9:
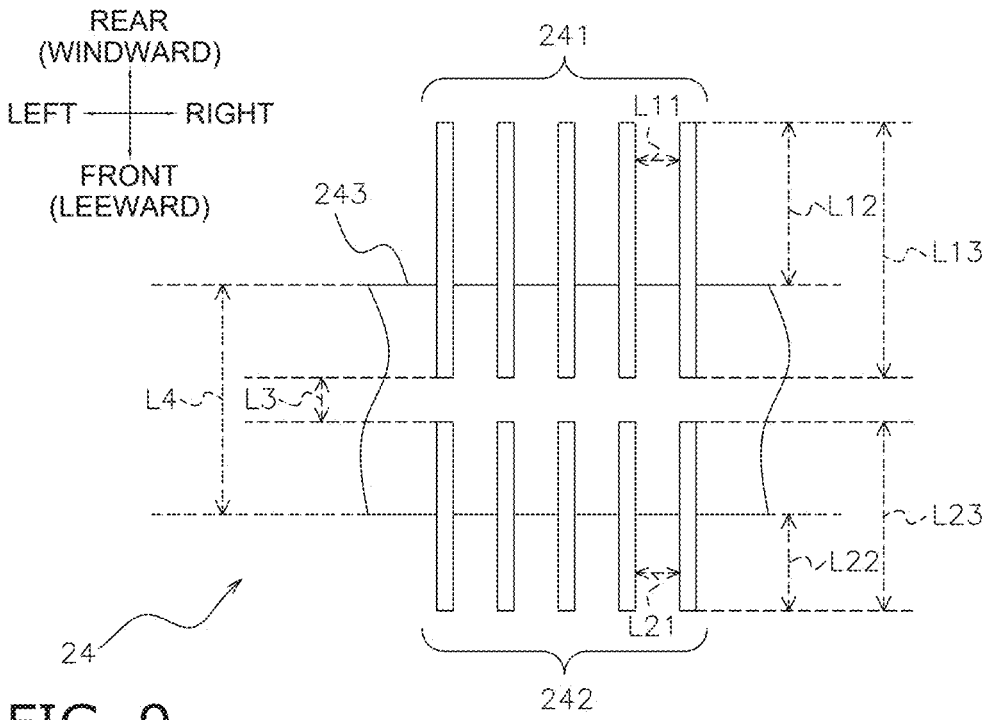
FIG. 9 is a schematic top view of the outdoor heat exchanger according to embodiments of Modification 1A.

In the present embodiments, the width L12 in the air flow direction of the first connection portion 241*b* is equal to the width L22 in the air flow direction of the second connection portion 242*b*. However, for example, as shown in FIG. 9, the width L12 in the air flow direction of the first connection portion 241*b* may be larger than the width L22 in the air flow direction of the second connection portion 242*b*.

Consequently, the outdoor heat exchanger 24 can delay frosting of an end portion on the windward side of the first heat transfer fin 241 by locating the end portion on the windward side of the first heat transfer fin 241 away from the flat tubes 243.

(6-2) Modification 1B

Figure 10:
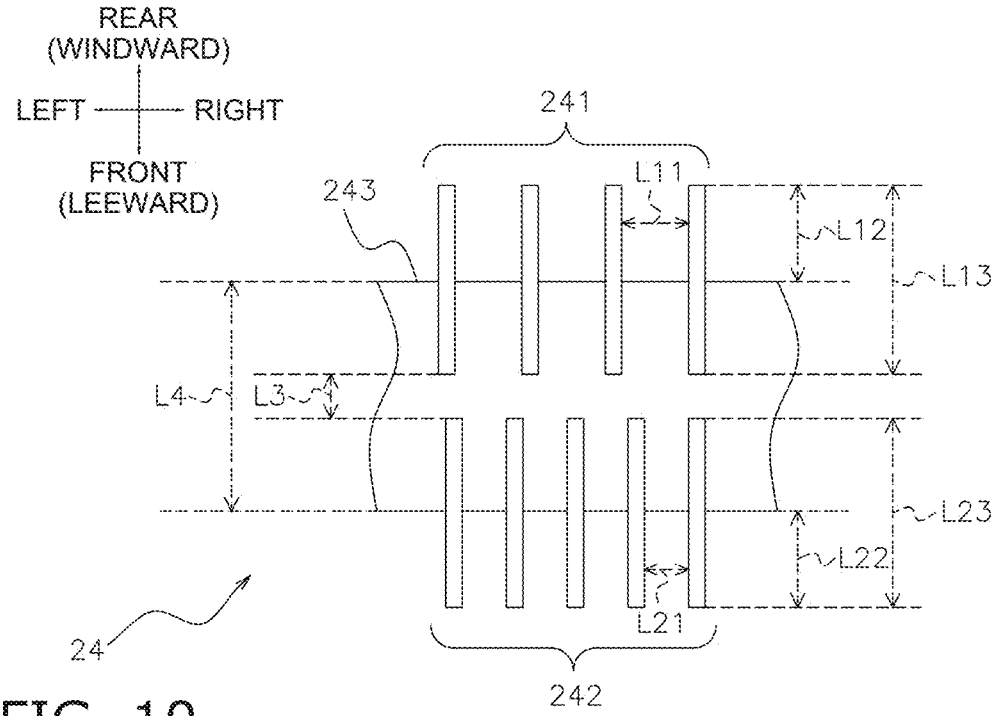
FIG. 10 is a schematic top view of the outdoor heat exchanger according to embodiments of Modification 1B.

In the present embodiments, the fin pitch L11 of the plurality of first heat transfer fins 241 is equal to the fin pitch L21 of the plurality of second heat transfer fins 242. However, for example, as shown in FIG. 10, the fin pitch L11 of the plurality of first heat transfer fins 241 may be larger than the fin pitch L21 of the plurality of second heat transfer fins 242.

Consequently, the outdoor heat exchanger 24 can prevent the plurality of first heat transfer fins 241 from being closed by frosting and delay frosting.

(6-3) Modification 1C

In the present embodiments, the distance L3 in the air flow direction between the first heat transfer fin 241 and the second heat transfer fin 242 is 1 mm or more. However, for example, the distance L3 in the air flow direction between the first heat transfer fin 241 and the second heat transfer fin 242 may be equal to or more than the fin pitch L11 of the plurality of first heat transfer fins 241 and may be equal to or more than the fin pitch L21 of the plurality of second heat transfer fins 242.

Consequently, the outdoor heat exchanger 24 can prevent the end portion on the windward side of the second heat transfer fin 242 from being closed by frosting and delay frosting.

(6-4) Modification 1D

Figure 11:
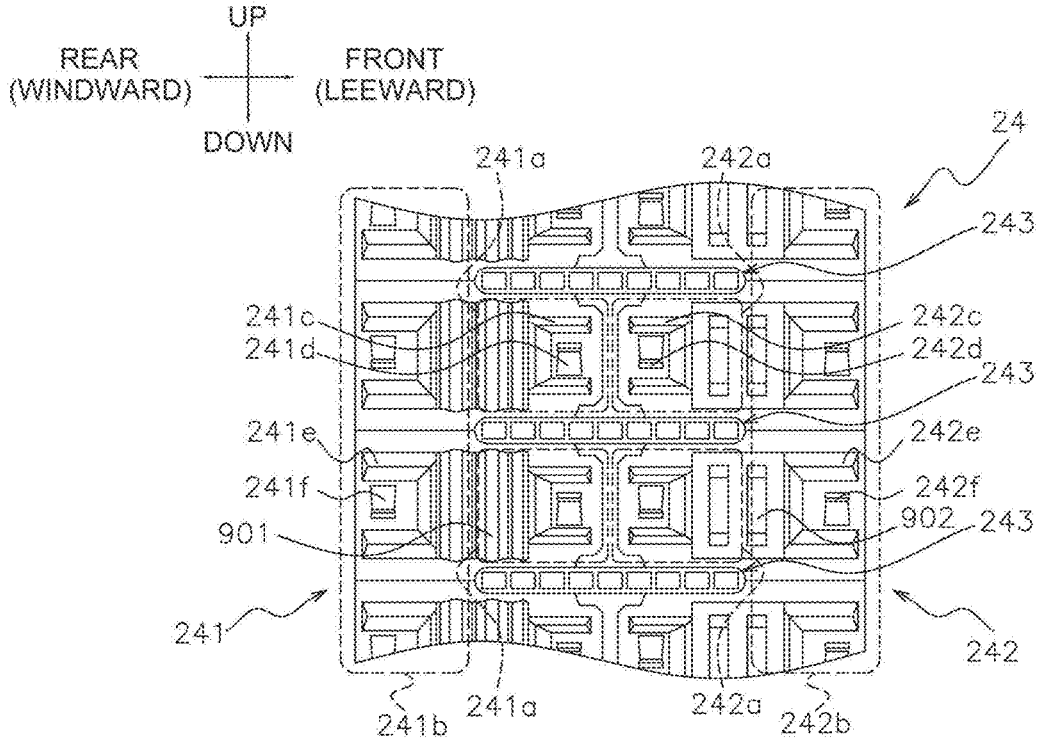
FIG. 11 is an enlarged sectional view of the outdoor heat exchanger according to embodiments of Modification 1D.

For example, the first heat transfer fin 241 and the second heat transfer fin 242 may have different fin shapes. For example, as shown in FIG. 11, a waffle 901 may be formed in the first heat transfer fin 241, and a louver or a slit 902 may be formed in the second heat transfer fin 242.

Consequently, the outdoor heat exchanger 24 can separate the effects of the first heat transfer fin 241 and the second heat transfer fin 242, for example, by forming the first heat transfer fin 241 into a shape having a frosting delaying effect and forming the second heat transfer fin 242 into a shape having a heat transfer promoting effect.

(6-5) Modification 1E

Figure 12:
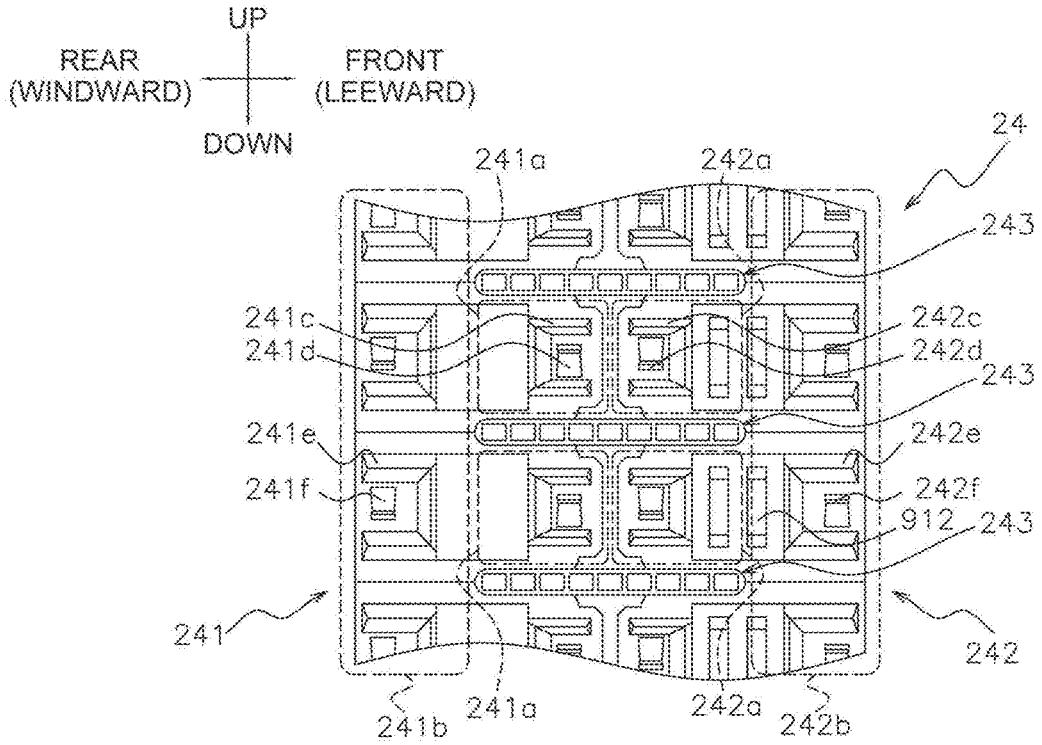
FIG. 12 is an enlarged sectional view of the outdoor heat exchanger according to embodiments of Modification 1E.

For example, as shown in FIG. 12, the first heat transfer fin 241 and the second heat transfer fin 242 may have cuts in different states. The state of a cut includes the presence or absence of the cut shown as a slit 912.

(6-6) Modification 1F

Figure 13:
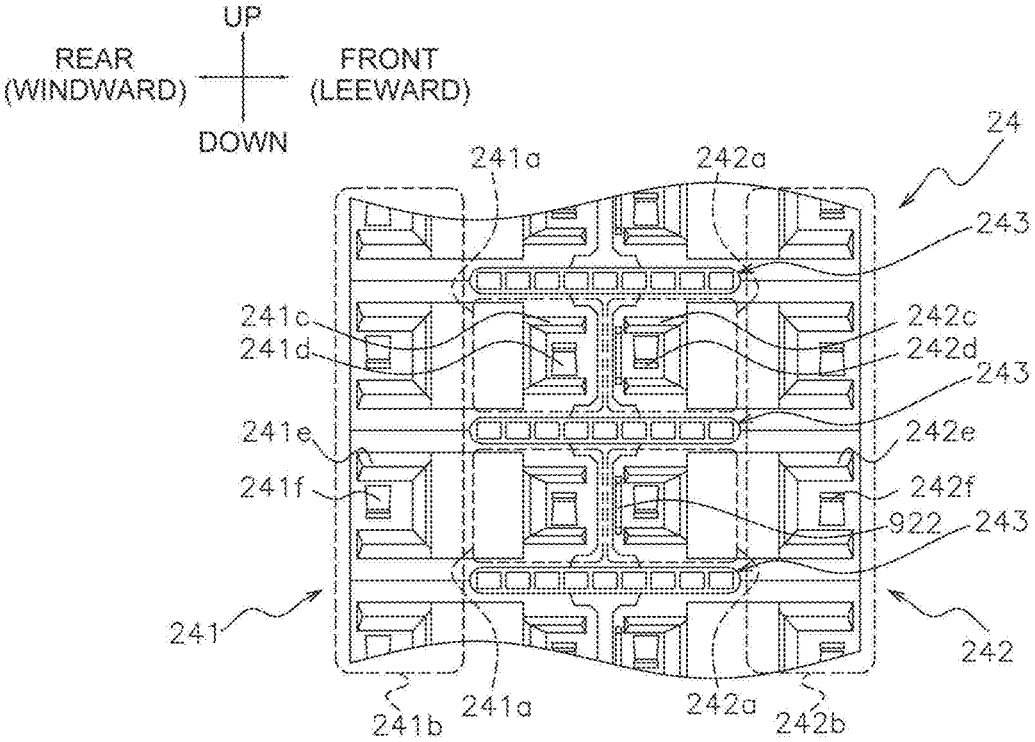
FIG. 13 is an enlarged sectional view of the outdoor heat exchanger according to embodiments of Modification 1F.

For example, as shown in FIG. 13, a cut such as a louver or a slit 922 may be formed in a front edge on the windward side of the second heat transfer fin 242.

(6-7) Modification 1G

Figure 14:
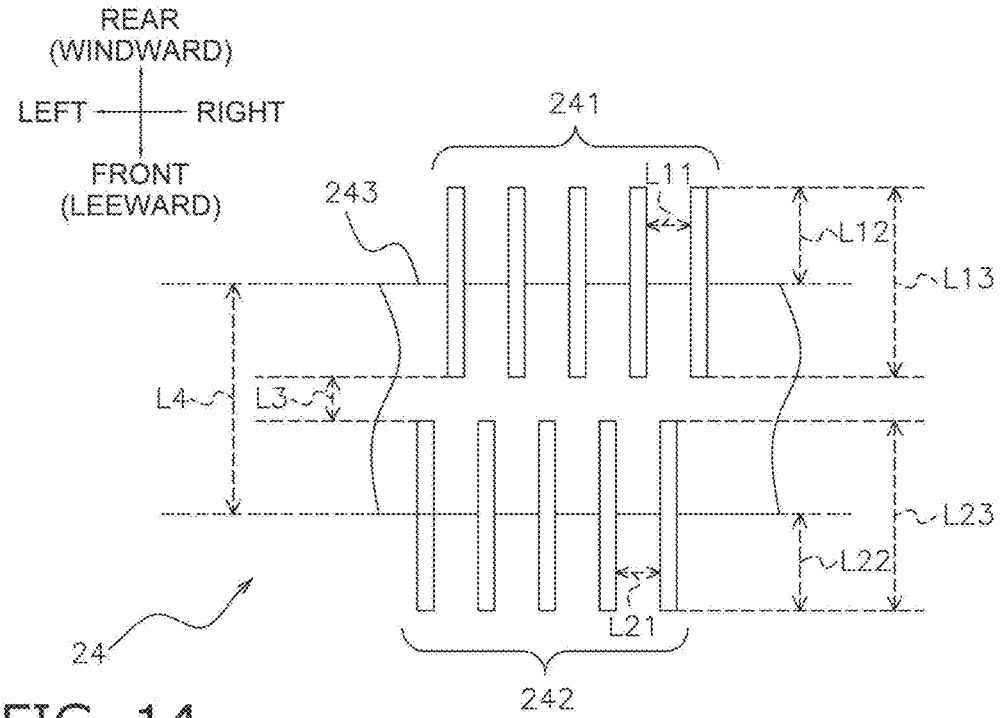
FIG. 14 is a schematic top view of the outdoor heat exchanger according to embodiments of Modification 1G.

In the present embodiments, the position of the first heat transfer fin 241 and the position of the second heat transfer fin 242 are substantially aligned with each other in the front-rear direction. However, for example, as shown in FIG. 14, the first heat transfer fin 241 and the second heat transfer fin 242 may be arranged in a staggered manner.

Consequently, the outdoor heat exchanger 24 can promote heat transfer of an edge portion on the windward side of the second heat transfer fin 242.

(6-8)

Although the disclosure has been described with respect to only a limited number of embodiments, those skilled in the art, having benefit of this disclosure, will appreciate that various other embodiments may be devised without departing from the scope of the present disclosure. Accordingly, the scope of the disclosure should be limited only by the attached claims.

REFERENCE SIGNS LIST

24 outdoor heat exchanger (heat exchanger)
241 first heat transfer fin
241*a* first insertion portion
241*b* first connection portion
242 second heat transfer fin
242*a* second insertion portion
242*b* second connection portion
243 flat tube
L11 fin pitch of first heat transfer fins
L12 width in air flow direction of first connection portion
L21 fin pitch of second heat transfer fins
L22 width in air flow direction of second connection portion
L3 distance in air flow direction between first heat transfer fin and second heat transfer fin
L4 length in longitudinal direction of cross section of flat tube

PATENT LITERATURE

PTL 1: Japanese Unexamined Patent Application Publication No. 2019-15410

What is claimed is:

1. A heat exchanger that exchanges heat between a refrigerant and air, comprising:

flat tubes disposed in a first direction intersecting with a longitudinal direction of cross sections of the flat tubes and through which the refrigerant flows;

first heat transfer fins that contact the flat tubes and are disposed on a windward side of the flat tubes, wherein the first heat transfer fins are inserted toward the flat tubes from a side of first ends in the longitudinal direction; and second heat transfer fins that contact the flat tubes and are disposed on a leeward side of the flat tubes, wherein the second heat transfer fins are inserted toward the flat tubes from a side of second ends in the longitudinal direction, wherein the first heat transfer fins each comprise:

first insertion portions that are each inserted between adjacent ones of the flat tubes; and a first connection portion that extends in the first direction and that connects the first insertion portions outside the first ends in the longitudinal direction of the cross sections of the flat tubes, the second heat transfer fins each comprise:

second insertion portions that are each inserted between adjacent ones of the flat tubes; and a second connection portion that extends in the first direction and that connects the second insertion portions outside the second ends in the longitudinal direction of the cross sections of the flat tubes, a distance in an air flow direction between the first heat transfer fins and the second heat transfer fins is:

1 mm or greater, and

20% or less of a length of the cross sections of the flat tubes in the longitudinal direction.

2. The heat exchanger according to claim 1, wherein a width of the first connection portion in an air flow direction is greater than a width of the second connection portion in the air flow direction.

3. The heat exchanger according to claim 1, wherein a fin pitch of the first heat transfer fins is greater than a fin pitch of the second heat transfer fins.

4. The heat exchanger according to claim 1, wherein the distance in an air flow direction between the first heat transfer fins and the second heat transfer fins is equal to or greater than both:

a fin pitch of the first heat transfer fins, and a fin pitch of the second heat transfer fins.

5. The heat exchanger according to claim 1, wherein the first heat transfer fins and the second heat transfer fins have different fin shapes.

6. The heat exchanger according to claim 1, wherein at least some but not all of the first heat transfer fins and the second heat transfer fins have cuts.

7. The heat exchanger according to claim 1, wherein a cut is formed in a front edge on a windward side of each of the second heat transfer fins.

8. The heat exchanger according to claim 1, wherein the first heat transfer fins and the second heat transfer fins are formed of a clad material.

9. The heat exchanger according to claim 1, wherein the first heat transfer fins and the second heat transfer fins are disposed in a staggered manner.

10. A heat exchanger that exchanges heat between a refrigerant and air, comprising:

flat tubes disposed in a first direction intersecting with a longitudinal direction of cross sections of the flat tubes and through which the refrigerant flows;

first heat transfer fins that contact the flat tubes and are disposed on a windward side of the flat tubes, wherein the first heat transfer fins are inserted toward the flat tubes from a side of first ends in the longitudinal direction; and second heat transfer fins that contact the flat tubes and are disposed on a leeward side of the flat tubes, wherein the second heat transfer fins are inserted toward the flat tubes from a side of second ends in the longitudinal direction, wherein the first heat transfer fins each comprise:

first insertion portions that are each inserted between adjacent ones of the flat tubes; and a first connection portion that extends in the first direction and that connects the first insertion portions outside the first ends in the longitudinal direction of the cross sections of the flat tubes, the second heat transfer fins each comprise:

second insertion portions that are each inserted between adjacent ones of the flat tubes; and a second connection portion that extends in the first direction and that connects the second insertion portions outside the second ends in the longitudinal direction of the cross sections of the flat tubes, and a distance in an air flow direction between the first heat transfer fins and the second heat transfer fins is equal to or greater than both:

a fin pitch of the first heat transfer fins, and a fin pitch of the second heat transfer fins.

11. The heat exchanger according to claim 10, wherein a width of the first connection portion in an air flow direction is greater than a width of the second connection portion in the air flow direction.

12. The heat exchanger according to claim 10, wherein a fin pitch of the first heat transfer fins is greater than a fin pitch of the second heat transfer fins.

13. The heat exchanger according to claim 10, wherein the distance in an air flow direction between the first heat transfer fins and the second heat transfer fins is 1 mm or greater.

14. The heat exchanger according to claim 10, wherein the distance in an air flow direction between the first heat transfer fins and the second heat transfer fins is 20% or less of a length of the cross sections of the flat tubes in the longitudinal direction.

15. The heat exchanger according to claim 10, wherein the first heat transfer fins and the second heat transfer fins have different fin shapes.

16. The heat exchanger according to claim 10, wherein at least some but not all of the first heat transfer fins and the second heat transfer fins have cuts.

17. The heat exchanger according to claim 10, wherein a cut is formed in a front edge on a windward side of each of the second heat transfer fins.

18. The heat exchanger according to claim 10, wherein the first heat transfer fins and the second heat transfer fins are formed of a clad material.

19. The heat exchanger according to claim 10, wherein the first heat transfer fins and the second heat transfer fins are disposed in a staggered manner.

* * * * *